US007950080B2

(12) United States Patent
Brossart et al.

(10) Patent No.: US 7,950,080 B2
(45) Date of Patent: May 31, 2011

(54) PATIENT TRANSFER MECHANISM AND GURNEY EQUIPPED THEREWITH

(75) Inventors: Ray Brossart, Portland, OR (US); Dave Trammel, Clackamas, OR (US); Ken Klunder, Oregon City, OR (US)

(73) Assignee: KDR of Oregon, LLC, Clackamas, OR (US)

( * ) Notice: Subject to any disclaimer, the term of this patent is extended or adjusted under 35 U.S.C. 154(b) by 595 days.

(21) Appl. No.: 11/897,578

(22) Filed: Aug. 30, 2007

(65) Prior Publication Data

US 2009/0056012 A1 Mar. 5, 2009

(51) Int. Cl.
*A61G 7/00* (2006.01)

(52) U.S. Cl. ..... 5/81.1 C; 5/81.1 R

(58) Field of Classification Search ..... 5/81.1 R, 5/83.1, 86.1, 81.1 C, 81.1 T; 254/98, 2 B, 254/278, 283; 414/400
See application file for complete search history.

(56) References Cited

U.S. PATENT DOCUMENTS

| | | | | | |
|---|---|---|---|---|---|
| 3,493,979 | A | * | 2/1970 | Crook, Jr. et al. | 5/81.1 C |
| 3,765,037 | A | * | 10/1973 | Dunkin | 5/81.1 C |
| 3,871,036 | A | * | 3/1975 | Attenburrow | 5/81.1 C |
| 3,967,328 | A | * | 7/1976 | Cox | 5/81.1 C |
| 4,077,073 | A | * | 3/1978 | Koll et al. | 5/81.1 C |
| 4,680,818 | A | * | 7/1987 | Ooka et al. | 5/81.1 C |
| 4,794,655 | A | * | 1/1989 | Ooka et al. | 5/81.1 C |

* cited by examiner

*Primary Examiner* — Michael Trettel
*Assistant Examiner* — William Kelleher
(74) *Attorney, Agent, or Firm* — James G. Stewart PC

(57) ABSTRACT

A patient transfer mechanism includes a horizontal frame positionable along the side of a bed; a support plate substantially coextensive with and fixedly mounted to the frame; and a movable transfer plate nominally resting on the support plate and being capable of being extended and retracted therealong while resting also partly on the bed; the transfer plate being covered throughout its movement by an adjustable length of fabric extending therearound, the length of fabric being adjusted proportional to and in synchronism with movement of the transfer plate in such manner that a variable upper planar extent of the length of fabric is fixedly positioned relative to an upper planar surface of the transfer plate, the transfer plate and the fabric being configured to transfer a patient from or to the bed. A gurney mounting such a patient transfer mechanism also is described.

28 Claims, 6 Drawing Sheets

PATIENT TRANSFER MECHANISM AND GURNEY EQUIPPED THEREWITH

BACKGROUND OF THE INVENTION

This invention relates generally to the field of transferring a patient from a stationary and preferably elevated surface onto a mobile transport mechanism such as a hospital gurney. More particularly, it concerns a patient transfer mechanism and gurney equipped therewith for transferring a patient from a hospital bed or the like onto the gurney (or vice versa).

Bedded patients are often relatively immobilized and incapable even of assisting in their transfer to a gurney. Conventionally, multiple hospital staff members move a patient from a bed to a gurney by manually grasping the four corners of a bed sheet and lifting the patient situated on the sheet laterally from the surface of the bed to the surface of a bedside-situated gurney. Sometimes, a special lift pad first is incrementally maneuvered underneath the patient by rolling the patient to one side, pushing the middle region of the pad partly underneath the patient, flattening the pad on the first side of the patient, then rolling the patient to the other side beyond the pad, then grasping the second side of the pad from underneath the patient and flattening the pad on the second side of the patient. The patient with the pad flattened underneath him or her is then lifted as one, in the manner described above for the sheet.

After the transfer to the gurney, the above process often must be repeated to remove the sheet or lift pad from underneath the patient.

Such laborious maneuvers must be repeated each time the patient is to be transferred to or from the gurney. Moreover, the special lift pad must be laundered each time after use for hygiene and sanitation reasons.

Patient discomfort results from such transfers, even when attempted by the best trained and most caring hospital or field staff.

SUMMARY OF THE INVENTION

A patient transfer mechanism includes a horizontal frame positionable along the side of a bed; a support plate substantially coextensive with and fixedly mounted to the frame; and a movable transfer plate nominally resting on the support plate and being capable of being extended and retracted therealong while resting also partly on the bed; the transfer plate being covered throughout its movement by an adjustable length of fabric extending therearound, the length of fabric being adjusted proportional to and in synchronism with movement of the transfer plate in such manner that a variable upper planar extent of the length of fabric is fixedly positioned relative to an upper planar surface of the transfer plate, the transfer plate and the fabric being configured to transfer a patient from or to the bed. A gurney mounting such a patient transfer mechanism also is described.

DETAILED DESCRIPTION OF THE PREFERRED EMBODIMENTS

The invention in accordance with a preferred embodiment involves an automatic bedside lift for transferring a reclining mammal, e.g. a human patient, from one horizontal elevated surface to another, e.g. from a bed to a stretcher or so-called gurney (or vice versa). Much of the conventional manual labor described above is obviated by such a semiautomatic bedside transport mechanism as described, illustrated and claimed herein. Labor savings and attendant cost savings, as well as stress, strain and possible repetitive motion-related workmen's compensation claims on and by hospital or field staff and discomfort by patients can be substantially reduced or eliminated by use of the invented bedside transport mechanism. (Hospital as used herein broadly refers to a patient care facility including a clinic, a nursing home, etc. Field as used herein broadly refers to a non-facility setting including an accident site, a battle field, etc.)

Figure 1:
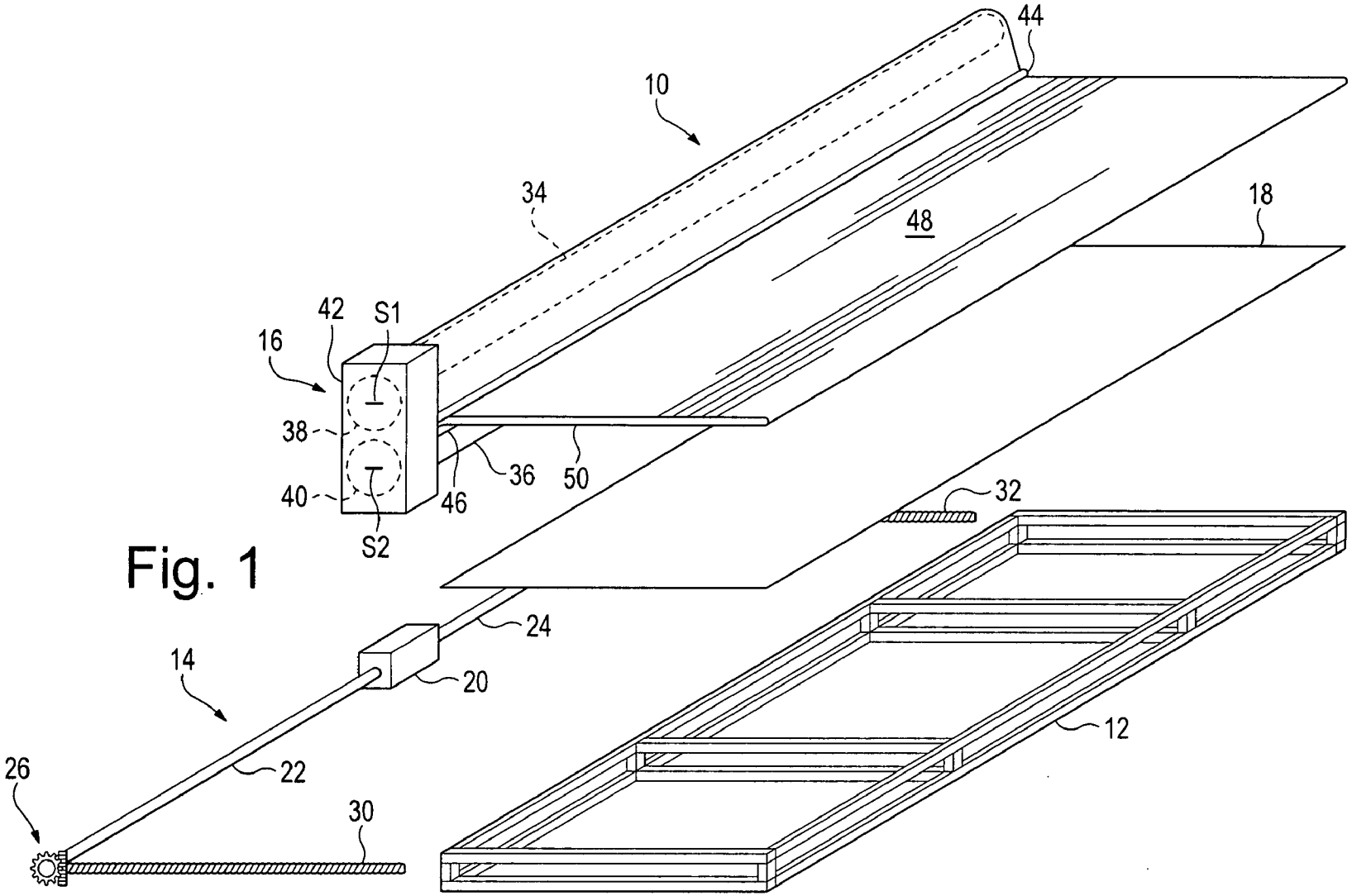
FIG. 1 is an exploded isometric assembly diagram that illustrates the invented patient transfer mechanism.

FIG. 1 is an exploded isometric assembly diagram that illustrates the transfer mechanism that forms a part of the invented bedside lift. Transfer mechanism 10 includes a main bed frame 12, a reciprocating mechanism 14, a spooling mechanism 16 including a dual roller and fabric assembly 48, and a lower support panel (board) 18. Reciprocating mechanism 14 in accordance with one embodiment of the invention takes the form of an extension/retraction mechanism including a transfer (drive) motor 20; two drive shafts 22, 24; two gear assemblies 26, 28 (gear assembly 28 not shown in FIG. 1 but visible in FIG. 2, discussed below); and two worm-screw shafts 30, 32. Spooling mechanism 16 includes a first (e.g. upper) feed/take-up roller 34 and a second (e.g. lower) feed/take-up roller 36; two roller drive motors 38, 40 (shown in outline behind a cover 42); two guide rollers 44, 46 and a contiguous length of sanitized fabric 48 extending around rollers 34, 36, 44, 46 and around a transfer shelf 50 that, as illustrated in the retracted position of transfer mechanism 10 of FIG. 1, generally coextensively overlies lower support panel 18.

Feed/take-up rollers 34 and 36 will be understood to be generally right-circular cylindrical, with smooth rolling surfaces, and to be mounted for selective motor-driven rotational control, e.g. in three modes of operation including a lock (immobilized) mode, (at, for example, M1 in FIG. 2), a tension (light braking) mode (at, for example, M2) and a predetermined take-up (oppositely directed at a given pace) mode (at, for example, M3). Those of skill in the art will appreciate that, in order automatically to cause fabric 48 to track and maintain alignment as it is spooled thereon, rollers 34 and 36 can be slightly inwardly tapered toward their outer ends, i.e. they may be slightly convexly shaped, as is known.

Figure 2:
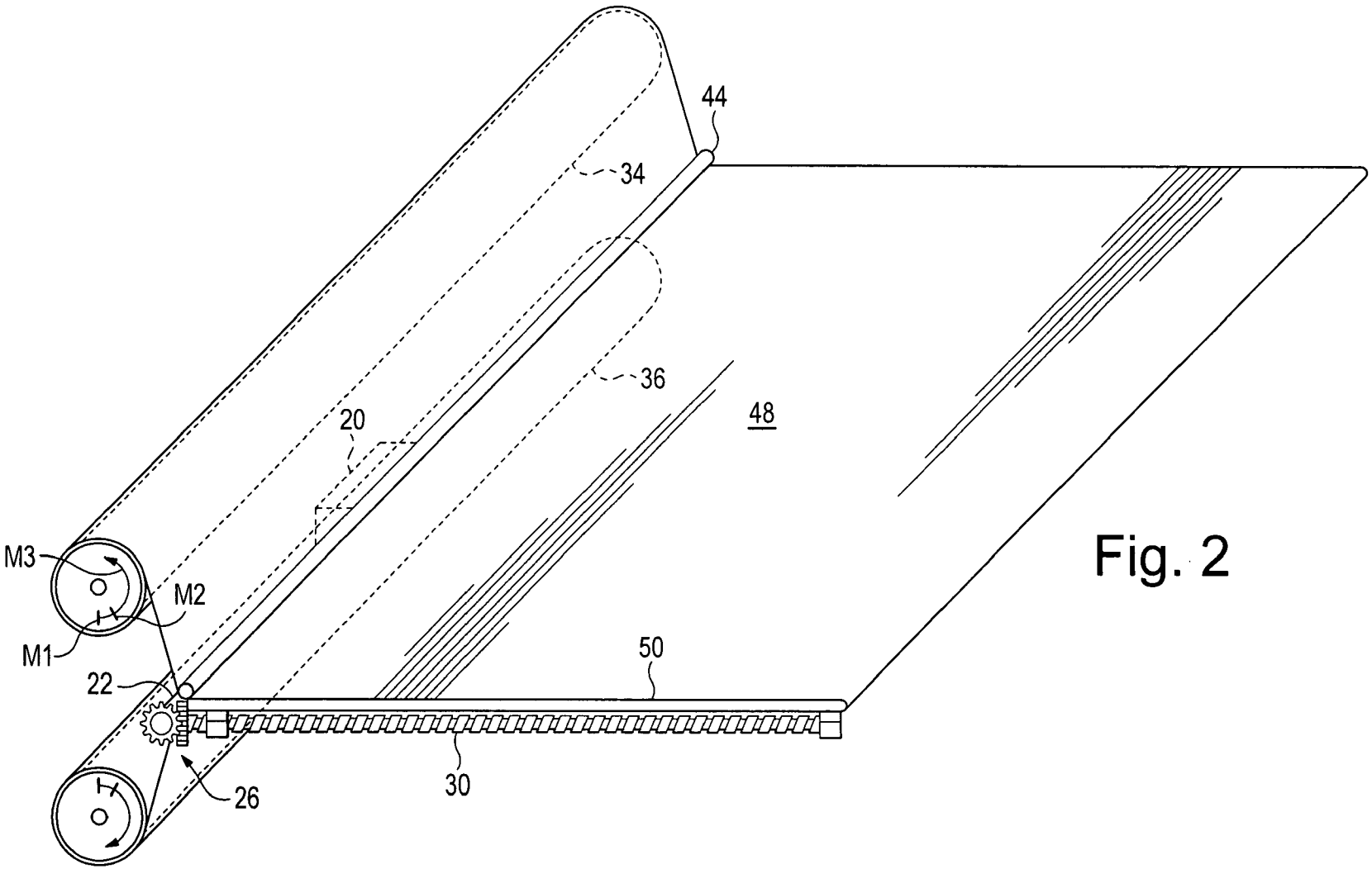
FIG. 2 is a schematic isometric diagram that illustrates in more detail key portions of the transfer mechanism of FIG. 1.

FIG. 2 is a schematic isometric diagram that illustrates in more detail key portions of transfer mechanism 10 and its operation.

Those of skill in the art will appreciate that transfer shelf 50 is smoothly extended and retracted (the latter being shown in FIG. 2) via reciprocating drive mechanism 14. Concurrently while transfer shelf 50 is extended, second (upper) take-up/feed roller 36 is locked while first (lower) feed/take-up roller 34 is tensioned, e.g. lightly braked. In this way, the upper run of fabric 48 is substantially stationary while the lower run of fabric 48 is extended along with the transport board to reach an interior region of the upper surface of the bed or gurney in which the patient reclines. Those of skill in the art will appreciate that the outer edge of transfer shelf 50 smoothly advances under the patient (or under the upper sheet on which the patient lies) smoothly and without discomfort to the patient. From FIG. 1, it may be seen that fabric 48 is dimensioned to be slightly wider than lower support panel 18 so that, as it is extended and retracted, the fabric edges substantially cover the ends (e.g. the "head" and "foot") of frame 12.

Those of skill in the art also will appreciate that the outer edge of transfer shelf 50 smoothly advances under the patient without more than a nominal height or elevational difference therebetween. In other words, there is no intervening structure, whether stationary or moving, between the patient and the upper surface of the bed other than the thin, fabric-covered transfer shelf. (This distinguishes the invention over prior art mechanisms like that described in U.S. Pat. No. 4,794,655 to Ooka, et al. entitled TRUCK TYPE PATIENT-MOVING DEVICE. In accordance with such prior art teachings, a relatively thick base plate 1 and a relatively thick insertion plate 2 (the latter including an upper plate 3 and a lower plate 4) all must be maneuvered under a patient's body, admittedly producing "large friction" between upper plate 3 and upper belt 11, "this frictional force act[ing] as a disturbance counteracting the rotating force of the driving motor" sufficient to drop the advancing speed of the plate. Ooka, et al. resort to complex means to manipulate their thick, stacked, complex insertion structure.)

In contrast, the smooth and unobtrusive operation of the invented patient transfer mechanism is made possible by the substantial and preferably complete no-slip or no-creep or no-slide (stationary) position of the fabric along the transfer shelf's upper planar surface and outer edge coupled with the extension of the fabric along the transfer shelf's lower planar surface. It is also made possible by the relatively thin, smooth, and unobtrusive configuration of the transfer shelf. Those of skill in the art will appreciate that the thin, stationary fabric-covered outer edge of the transfer shelf advances under the patient's underside with minimum obstruction, interference, or discomfort, as the patient's body passively inches its way from the hospital bed onto the transfer shelf.

Concurrently while transfer shelf 50 is retracted with a patient in tow, second (lower) feed/take-up roller 36 is idled or lightly braked while first (upper) take-up/feed roller 34 is driven to take up fabric 48. In this way, the lower run of fabric 48 is advanced around the outside edge of transfer shelf 50 to become the (unused and clean) upper run thereon onto which the current patient will be transferred while the (used and potentially soiled portion of) upper run of fabric 48 from a previous patient is taken up on first (upper) roller 34. Thus a bedded patient can be comfortably transferred thereon onto a proximate, bedside gurney using invented transfer mechanism 10.

Such operation of first and second rollers 34, 36 can be very simply controlled by way of one or more switches S1 and S2 (not shown in FIG. 2 but shown in FIG. 1, discussed above, and in FIG. 5, discussed below) mounted on cover 42 (also not shown in FIG. 2), the manually operated switches controlling the on-off and take-up status of roller drive motors 38, 40 (also not shown in FIG. 2). Thus, a single operator, e.g. a hospital orderly, requiring no body strength whatsoever nevertheless can safely and comfortably transfer a patient from a bed to a gurney (or vice versa). Those of skill in the art will appreciate that the operation of take-up roller drive motors 38, 40 in accordance with one embodiment of the invention is synchronized with the operation of transfer drive motor 20 by a controller to be described below by reference to FIGS. 5 and 6.

Those of skill in the art will appreciate that nearly all of the patient's weight is at all times during transfer borne by the bed and/or durable lower support panel 18, which in turn is mounted on frame 12. Thus, the fabric and especially the transfer shelf can be relatively thin and unimposing despite the weight of the patient and the mechanics of movement thereof. This is due to the unique fabric spooling and shelf reciprocation mechanisms that work together synchronously in accordance with the invention.

To unload a patient reclining on the transfer mechanism, the above steps are reversed. In other words, second (lower) roller 36 is maintained in its lock mode while first (upper) roller 34 is driven in its tension/feed mode while the transfer shelf is extended onto the upper surface of the bed or patient support surface. After the patient is gently deposited on the bed, first (upper) roller 34 is driven in its take-up mode while second (lower) roller 36 is in its lock mode while the transfer shelf is fully retracted to its stowed position directly above the lower support panel. During a time between successive patients, typically the transfer mechanism is cleaned by advancing the used and possibly soiled extent of the roll of fabric onto first (upper) roller 34.

In this manner, the fabric roll progressively advances from the second (lower) roller to the first (upper) roller. Those of skill in the art will appreciate that, when the roll of fabric is used or exhausted, i.e. when its substantial length has been advanced with successive uses from the second (lower) roller to the first (upper) roller, it can be replaced with a fresh, clean, hygienic roll of fabric. The used roll of fabric can be laundered and reused, if desired.

Those of skill in the art will appreciate that, in accordance with the invention, the fabric needs to be durable and to have a relatively low coefficient of friction. Such provides sufficient lateral force to move a patient while avoiding tears (from too much tension) or wrinkles (from too little tension) and while ensuring that the fabric's engagement with the bed surface is relatively unimpeded and thus relatively smooth. Thus, any suitable fabric can be used within the spirit and scope of the invention and the invention not limited to any particular type of material, weave, finish, or other fabric structure or manufacturing process.

Those of skill in the art will appreciate that, for safety reasons during an electrical power brownout or blackout, a manual override system can be provided to transfer mechanism 10 in accordance with the invention. Such a manual override system will be understood to include a manual hand crank operatively coupled with a gear train (e.g. including a forward/reverse gear and clutch to drive the upper and lower rollers and the transfer shelf in their proper directions and with proper synchronization). Thus, patients can be safely transported from bed to gurney and vice versa even in the face of a lack of electrical power to operate the semi-automatic drive mechanism described and illustrated herein.

Figure 3:
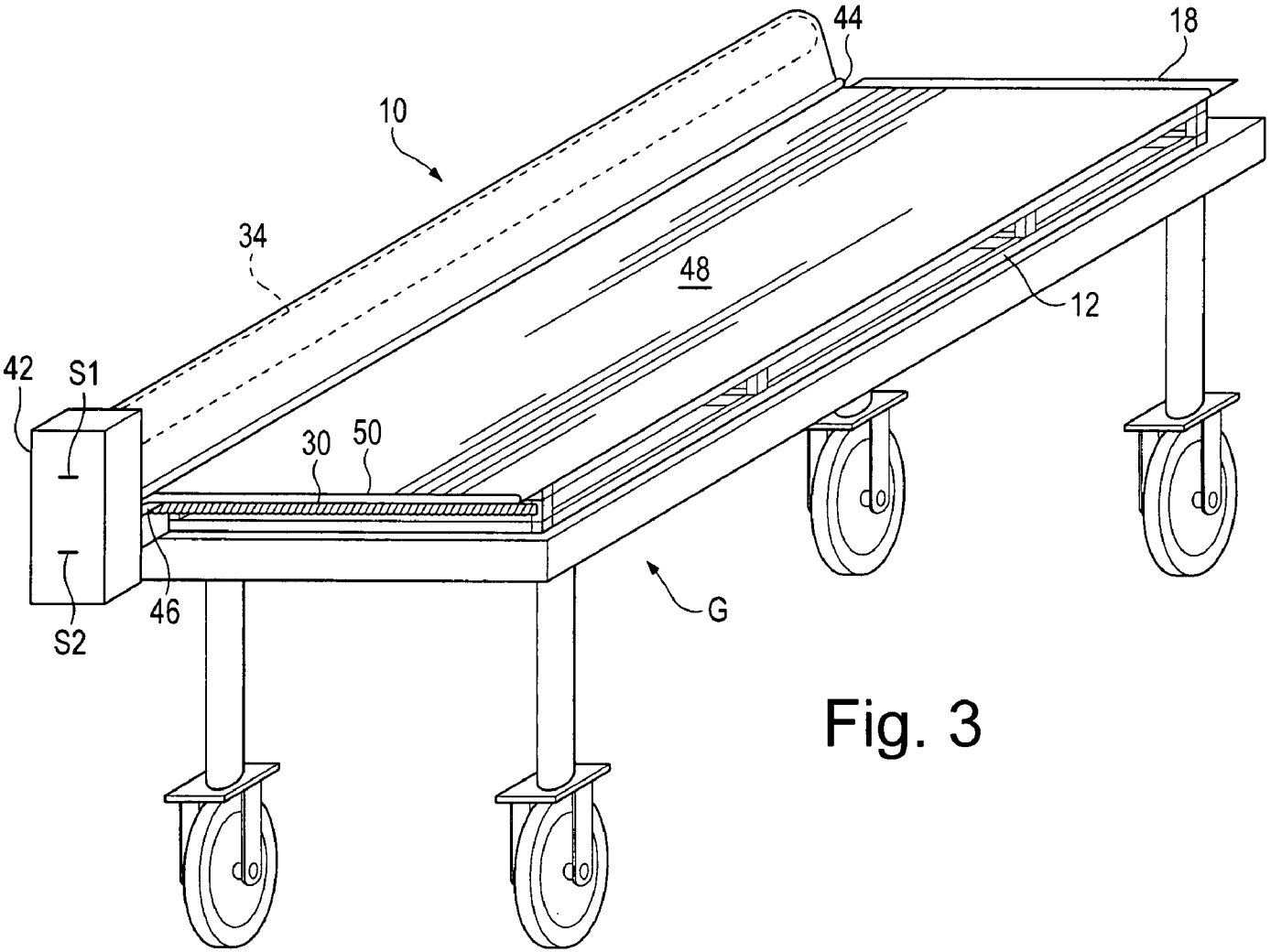
FIG. 3 is an isometric assembly diagram illustrating the transfer mechanism mounted atop a gurney with the transfer shelf in its retracted position.
Figure 4:
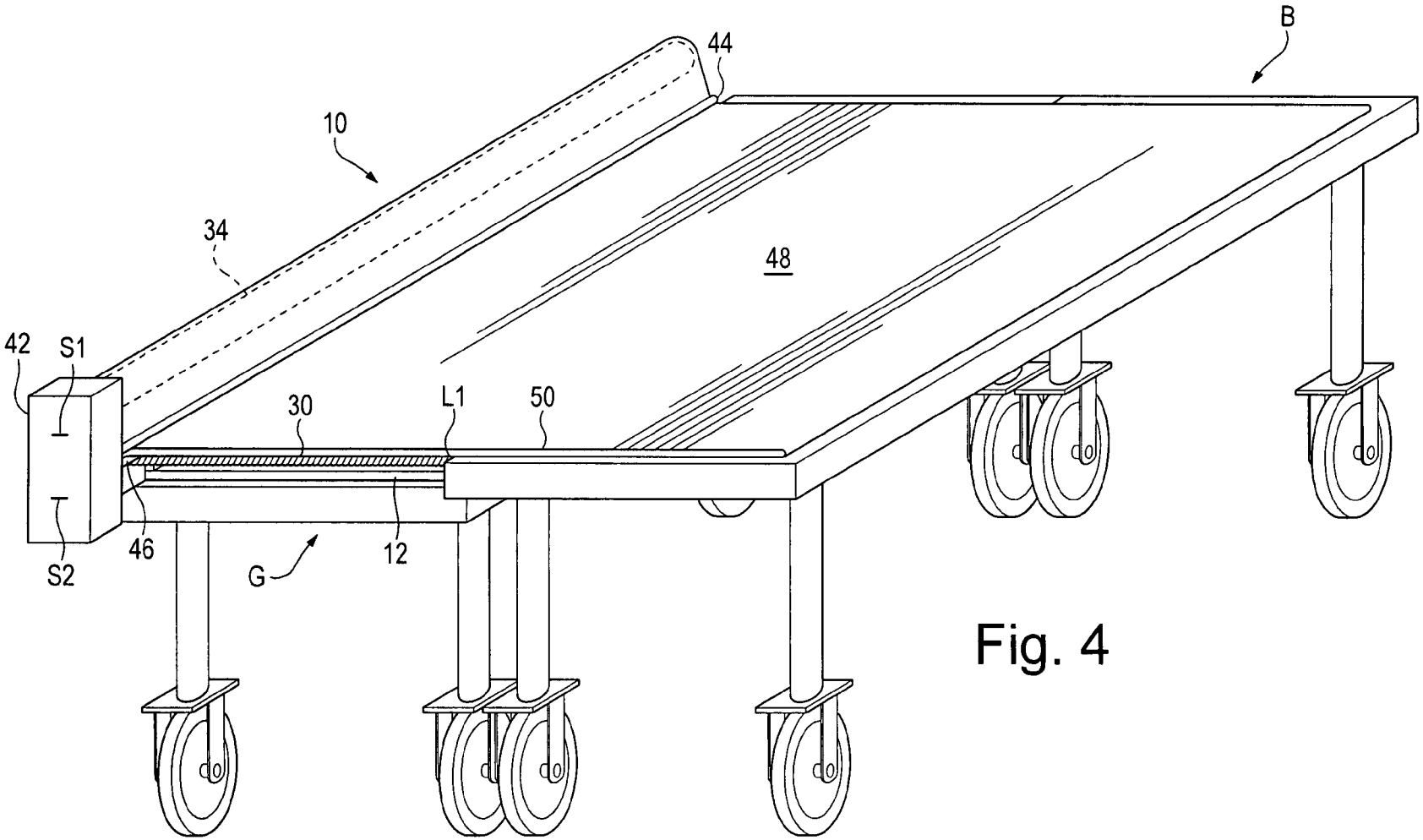
FIG. 4 is an isometric assembly diagram illustrating the transfer mechanism mounted atop a gurney with the transfer shelf in its extended position.

FIGS. 3 and 4 are isometric assembly diagrams illustrating transfer mechanism 10 mounted atop a gurney G having a wheeled base with transfer shelf 50 respectively in its retracted (FIG. 3) and extended (FIG. 4) positions relative to a hospital bed B (or another gurney or other elevated surface). Those of skill in the art will appreciate that transfer mechanism 10 typically might be so mounted, so that it forms a part of a hospital gurney for transporting patients. Those of skill in the art also will appreciate that an installed base of gurneys G can be retrofitted by mounting invented transfer mechanism 10 thereon. Thus, in accordance with one embodiment of the invention, corresponding dimensions are rendered identical between an existing gurney specification and the invented transfer mechanism.

Those of skill will appreciate that most existing gurneys G are equipped with hand-crank, pneumatic/hydraulic and/or worm gear and/or motorized elevators (not shown for the sake of clarity) that provide a range of elevations for the top surface of the gurney compatible with a range of elevations for the top surface of bed B (refer to FIG. 4). Such elevator mechanism of whatever means is contemplated as being incorporated in gurney G that also is equipped with the invented patient transfer mechanism. Such enables an operator quite simply to elevate the transfer mechanism to the proper height corresponding with the upper surface of bed B before commencing patient transfer as described herein.

Those of skill in the art will appreciate that the spooling mechanism motors are relatively low torque and low pace (angular speed). Those of skill in the art also will appreciate that the reciprocating mechanism motor is relatively low torque and high pace wherein the high pace is transformed into high torque by the use of dual worm screw shafts. In accordance with one embodiment of the invention, the transfer shelf is extended and retracted at a pace (linear speed) of between approximately twenty and thirty inches per minute (20-30"/minute). The pace at which the roll of fabric is advanced or retreated is similar, and, during certain phases of operation that will be described below by reference to FIG. 6, substantially or completely identical. At such relatively low speeds, the motors are not unduly taxed and would expect reliably and without incident to endure thousands or perhaps tens of thousands of patient load/unload and fabric clean cycles. Nevertheless, it is contemplated that, within the spirit and scope of the invention, the motors can be further protected from burnout using any suitable means such as belts, clutches, slip rings, etc. between the motors' drive shafts and their respective rotational loads.

Figure 5:
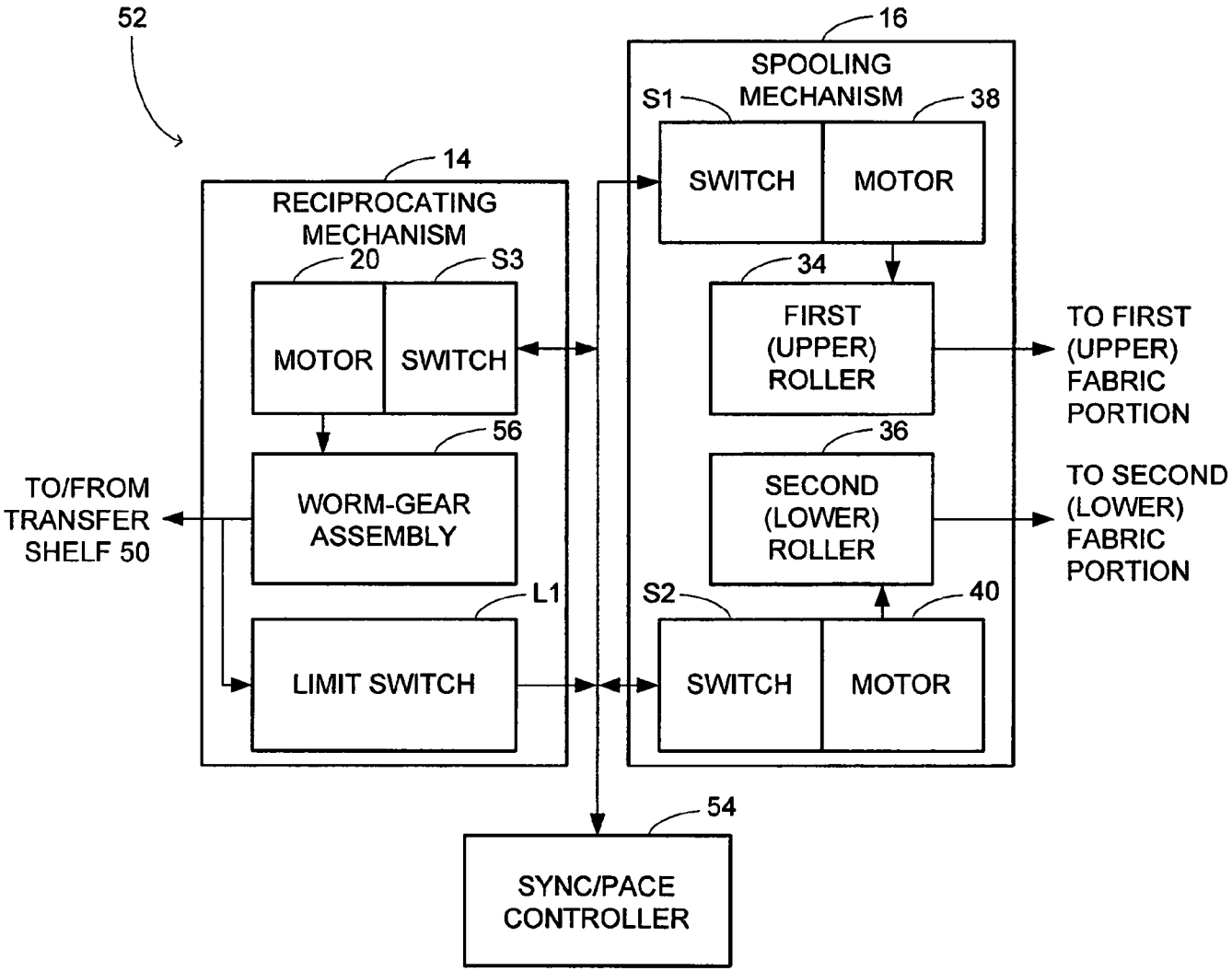
FIG. 5 is a schematic block diagram of the control and electro-mechanic and circuit topology in accordance with one embodiment of the invention.
Figure 6:
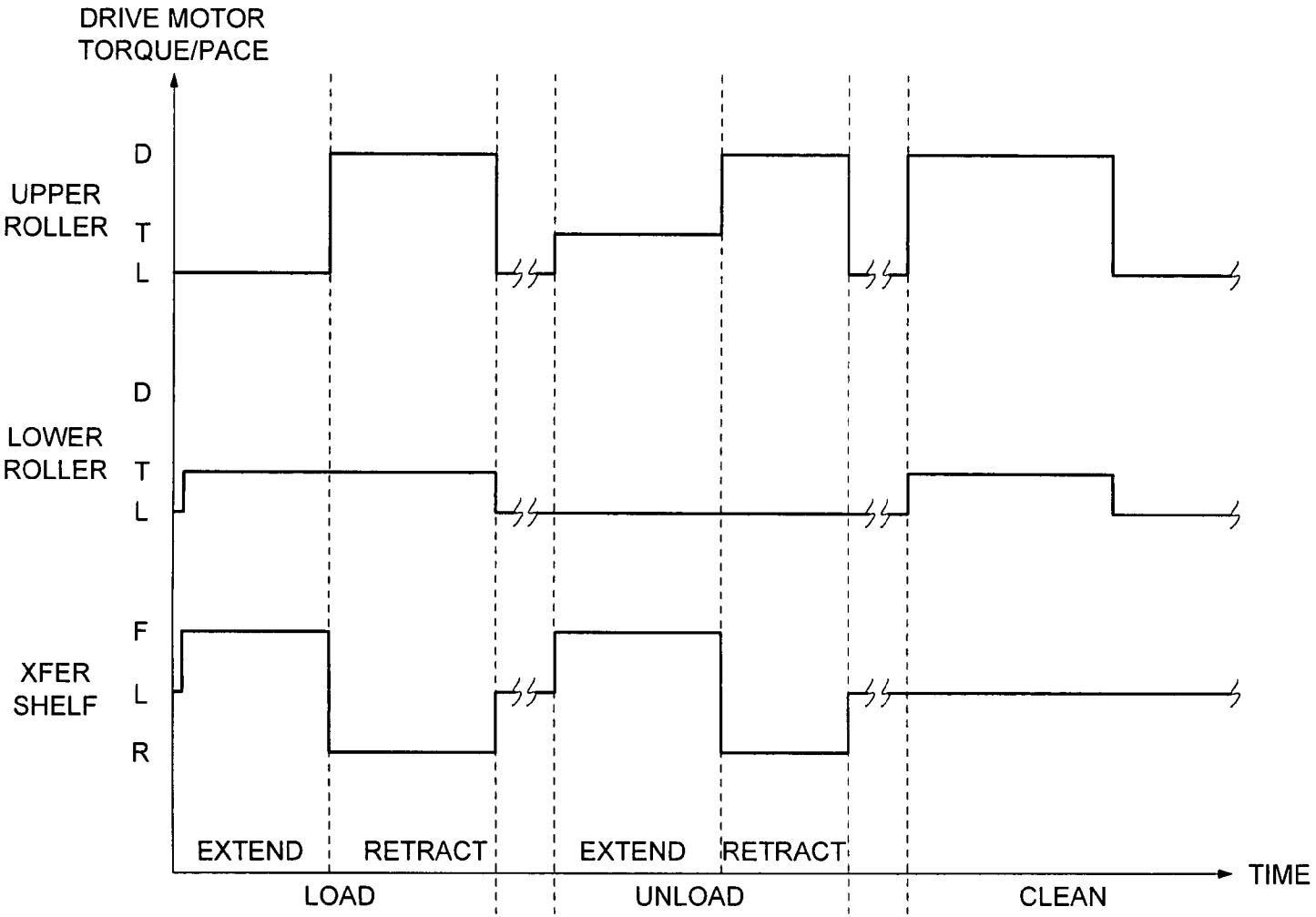
FIG. 6 is a graphic depiction of various phases of operation of the patient transfer mechanism of FIG. 1 illustrating the invented patient method.

FIGS. 5 and 6 illustrate the timing and control electronics and protocols for the motors that drive the reciprocating and spooling mechanisms.

FIG. 5 is a simplified schematic diagram of the electro-mechanics 52 that form a part of the invented patient transfer mechanism. Identical components described by reference to FIGS. 1-4 above are designated by identical reference designators.

Electro-mechanics 52 includes reciprocating mechanism 14, spooling mechanism 16, and a synchronization (SYNC) and pacing (PACE) controller 54. Those of skill in the art will appreciate that controller 54 operatively couples reciprocating mechanism 14 and spooling mechanism 16 such that the timing and pace (angular or linear speed) of their operation is substantially synchronized and equalized. Such is desired in accordance with one embodiment of the invention to avoid slack or stress (i.e. excessive tension) in fabric 48, thereby ensuring a proper level of tautness therein.

Electro-mechanics 52 can be seen to include one or more manually operable switches S1 and S2 operatively coupled to controller 54 and described above for starting and stopping one or more of first and second take-up rollers or spools 34, 36. Electro-mechanics 52 also can be seen to include one or more additional manually operable switches such as switch S3 also operatively coupled to controller 54 for extending and retracting patient transfer shelf 50. In accordance with one embodiment of the invention, the switches operate to close a circuit only so long as they are pushed and held. This design of the switches provides a manual override safety feature and allows an operator of invented patient transfer mechanism 10 to control the movement of the transfer shelf and roll of fabric and to stop such movement if and when desired.

Those of skill in the art will appreciate that the functions of these two or more switches can be combined or differently partitioned between and among the physical switches, so that there might be more or fewer switches each providing fewer or more functions. For example, the three switching functions can be combined into two physical switches each of which when operated independently extends or retracts the transfer shelf while also starting or stopping the rollers for patient loading and unloading purposes, and both of which when operated concurrently lock the transfer shelf while advancing the fabric for cleaning purposes. Any combination and functionality of switches is contemplated as being within the spirit and scope of the invention.

It will be understood that the closing and opening of the two or more switches is detected by controller 54, which, in turn, precisely synchronizes and paces motors 20, 38, and 40 in accordance with a programmed servo control algorithm. One such suitable control algorithm is described below by reference to FIG. 6, although alternative algorithms are contemplated as being within the spirit and scope of the invention. In this manner, the motors' operation can be precisely coordinated and controlled such that proper tension is maintained in the fabric roll, the fabric roll is properly advanced, and that the patient transfer shelf is properly and safely reciprocated.

Two more features of electro-mechanics 52 are illustrated in FIG. 5.

First, electro-mechanics 52 include what is referred to in FIG. 5 as a worm-gear assembly 54 that controls transfer shelf 50. Those of skill in the art will appreciate that as described and illustrated above worm-gear assembly 54 in accordance with one embodiment of the invention includes drive shafts 22, 24, gear assemblies 26, 28, and worm-screw shafts 30, 32, although alternative worm-gear assembly components and configurations are contemplated as being within the spirit and scope of the invention.

Second, electro-mechanics 52 include one or more limit switches such as L1 operatively coupled to controller 52 for detecting when transfer shelf 50 has reached one or both of extension and retraction extents thereby automatically to shut off transfer drive motor 20 and in turn to halt one or more of the extension and retraction of the transfer shelf. Those of skill in the art will appreciate that one or more limit switches such as limit switch L1 can be mounted in appropriate positions on frame 12 adjacent lower support panel 18, as illustrated in FIG. 4.

Those of skill in the art will appreciate that, if desired, one or more additional limit switches such as limit switch L1 can be mounted adjacent spooling mechanism 16 to detect when second (lower) roller 36 is low and it is time to change the fabric roll.

FIG. 6 is a graph of time on the horizontal axis versus drive motor torque/rate (angular speed) on the vertical axis during various phases of operation of invented transfer mechanism 10. Specifically, the upper two graphs trace the complimentary operation of the motors that drive the upper and lower rollers of spooling mechanism 16, and the lower graph traces the operation of the motor that drives transfer (XFER) shelf 50 corresponding thereto during three phases of operation: loading of a patient, unloading of a patient, and cleaning of the exposed, used, and possibly soiled fabric (i.e. advancing the fabric rolls). In FIG. 6, it will be appreciated that D represents drive at a predeterminedly high or active pace, T represents drive at a predeterminedly low or tension pace (sufficient to produce a desire tension in the fabric extending between the rollers), and L represents lock against rotational movement.

The timing and torque/pace illustrated in FIG. 6 will be understood to be qualitatively, but not necessarily quantitatively, accurate in accordance with any given embodiment of the invention. Instead, it is illustrative only of the timing and phasing of the various motors' operation that is determined by the programming of controller 54. As such it is not intended to limit the scope or spirit of the invention in any way.

Thus, during the extension phase of a patient loading operation, the upper roller drive motor is locked while the lower roller drive motor is tensioned while the transfer shelf drive motor is operated in a first (Forward) direction. During the retraction phase of patient loading operation, the upper roller drive motor is driven while the lower roller drive motor is locked while the transfer shelf drive motor is operated in a second, opposite (Reverse) direction.

During the extension phase of a patient unloading operation, the upper roller drive motor is driven in its tensioned/feed mode while the lower roller drive motor is locked while the transfer shelf drive motor is operated in the first (Forward) direction. During the retraction phase of a patient unloading operation, the upper roller drive motor is driven in its take-up mode while the lower roller drive motor is locked while the transfer shelf drive motor is operated in the second, opposite (Reverse) direction.

Finally, during a cleaning operation by which the fabric roll is advanced onto a take-up spool in order to present a clean exposed length to the next patient, the upper roller drive motor is driven while the lower roller drive motor is tensioned while the transfer shelf drive motor is locked. In this way, the exposed, used (and possibly soiled) length of fabric extending around the transfer shelf is advanced a suitable amount such that the used portion is taken up onto the upper spool and such that a fresh, hygienic portion extends across the transfer shelf.

Those of skill in the art will appreciate that transfer mechanism 10 can take alternative forms within the spirit and scope of the invention. Those of skill also will appreciate that frame 12 can be made of any suitably durable structure and material such as lightweight, square-tubular aluminum perimeter and interior reinforcement segments welded together, as shown in FIG. 1, in what can be seen to be a two-high, vertically stacked and joined configuration. Motors 20, 36, 38 can be of any suitable speed, torque, wattage or other specification, e.g. they can be servo motors, referred to herein simply as "servos", or the like. Drive shafts 22, 24; gear assemblies such as gear assembly 26; and worm-screw shafts 28, 30 and all can be arranged in any suitable configuration and can be made of any suitable material, e.g. steel, aluminum, titanium, or the like. Rollers 34, 36, 44, and 46 can be of any suitable configuration and placement and also can be made of any suitable material, e.g. steel, aluminum, fiberglass, graphite, titanium, or the like. Fabric 48 can be of any suitable weight, construction, and material, e.g. calendared nylon. Alternatively, yet contemplated as being within the spirit and scope of the invention, canvas, muslin, or other woven or molded or extruded or otherwise formed natural or synthetic material preferably compatible with patient safety, hygiene and comfort.

The overall dimensions of transfer mechanism 10 typically are determined by the rated load and purpose, e.g. patient transportation. Very simply, the mechanism and its component parts are dimensioned to suit that load and purpose. Thus, alternative embodiments of the invention are contemplated, and all are within the spirit and scope of the invention.

Those of skill in the art will appreciate that, in accordance with one embodiment of the invention, lower support panel 18 and transfer shelf 50 are substantially co-extensive, dimensioned to accommodate a reclining patient, are nominally planar and are made of ¼" thick Teflon™. Any suitable alternative materials and thicknesses are contemplated as being within the spirit and scope of the invention.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

From the foregoing, those of skill in the art will appreciate that several advantages of the present invention include the following.

The present invention provides one-person semi-automatic operation of a patient transfer mechanism that can be a part of a wheeled-base gurney for patient transportation to and from a stationary bedside or other support surface to a distant place such as an operating room within or outside a facility. Rather than having to lift the patient, the transfer mechanism at all load bearing times rests on one or both of a fixedly frame-mounted lower support plate and the upper outside surface and edge of the bed. The transfer mechanism includes a spooling mechanism and a reciprocation mechanism, the latter including a thin planar shelf that eases under the patient's reclining body and then transfers the patient from the surface of the bed to the surface of the lower support plate. The spooling mechanism includes upper and lower rollers between which extends and traverses a length of contiguous rolled elongate sheet of fabric tautly around the transfer shelf throughout the extension and retraction thereof, with an upper extent and outside edge of the fabric extending in non-sliding, non-slipping engagement with the upper surface and outside edge of the transfer shelf.

Accordingly, there is little of no friction against and thus no irritation of the patient's body during the transfer. A simple controller controls the motor drives of both the spooling mechanism and the reciprocating mechanism so that the operation of the mechanisms are, by simple manual switch control by the operator, automatically synchronized and paced with one another. Between instances of loading and unloading a given patient, a cleaning cycle is manually controlled, also by switch, by which the fabric is advanced onto the take-up roll so that a fresh and hygienic expanse overlies the transfer shelf. The roll is washable and thus reusable.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

We claim:

1. A patient-transfer mechanism comprising:

a horizontal frame positionable along the side of a bed;

a support plate substantially coextensive with and fixedly mounted to the frame; and a movable transfer shelf nominally resting on the support plate during a stowage phase of operation, and being capable during a deployment phase of operation of being extended and retracted therealong and further along a top surface of a bed;

the transfer shelf being covered throughout its movement by an adjustable length of fabric extending therearound, the length of fabric being adjusted proportional to and in synchronism with movement of the transfer shelf, the length of fabric along a lower horizontal extent thereof being positioned by the support plate to contact the upper surface of a bed during the deployment phase, with the only intervening structure between the transfer shelf and the upper surface of a bed being the adjustable length of fabric extending therebetween. the movable transfer shelf and the adjustable length of fabric extending therearound having no underlying patient-transfer mechanism structure, the movable transfer shelf and the adjustable length of fabric extending therearound without underlying structure being collectively configured to transfer a patient from or to the bed.

2. The transfer mechanism of claim 1 further comprising:

a frame-mounted reciprocating mechanism for alternately extending and retracting the transfer plate shelf relative to the frame, the reciprocating mechanism including one or more worm screw drive mechanisms operatively coupled with one or more ends of the transfer plate.

3. The transfer mechanism of claim 2 in which the length of fabric is a contiguous roll of fabric, the transfer mechanism further comprising:

a frame-mounted spooling mechanism including two rollers around which the roll of fabric is spooled for alternately advancing and retreating the roll in synchronous operation with the reciprocating mechanism.

4. The transfer mechanism of claim 3 further comprising:

a wheeled base mounting the frame for transporting a patient to and from the side of the bed.

5. The transfer mechanism of claim 4, wherein the two rollers of the spooling mechanism are independently operable in three operational modes including a lock mode, a tension mode, and directionally opposing take-up modes.

6. The transfer mechanism of claim 5, wherein the two rollers of the spooling mechanism are operated in the opposite take-up modes one at a time.

7. The transfer mechanism of claim 6, wherein, for advancing the roll of fabric during a time between patients, the two rollers of the spooling mechanism are operated concurrently, a first one of the two rollers operating in the take-up mode and a second one of the two rollers operating in the tension mode.

8. A patient-transfer mechanism comprising:

a base;

a generally horizontally oriented reciprocal patient transfer shelf mounted on the base, the shelf including a reciprocating mechanism configured laterally to extend the shelf from a position thereabove through a patient-loading position spaced laterally apart from the base and thereafter laterally to retract the shelf to the position thereabove with a patient supported by the shelf and the base, the shelf being generally planar and extending along a first extension/retraction axis and also along an axis substantially perpendicular thereto, the shelf defining a bottom surface, a top surface, and an outer edge, a spooling mechanism mounted on the base, the spooling mechanism including independently operable first and second drive/take-up spools; and a contiguous sheet of fabric extending around the first spool in a first roll, across the bottom surface of the shelf in a first plane, around the outer edge of the shelf in a bend and across the top surface of the shelf in a second plane, and around the second spool in a second roll, the base being positionable near a patient reclining on a patient-support surface, the shelf being elevatable to the height of the patient-support surface, and the spooling mechanism and the reciprocating mechanism being operable synchronously with one another substantially to match a drive/take-up pace of the sheet with an extend/retract pace of the shelf, the shelf being configured to span and to be supported throughout its extension and retraction by one or both of the base and the patient-support surface, the shelf and the sheet of fabric extending therearound being the only patient-transfer mechanism structure intervening between the patient-support surface and a patient during deployment of the mechanism for patient transfer to or from a bed.

9. The mechanism. of claim 8, wherein the base includes a frame having a lower, solid, planar support in a planar horizontal configuration directly underlying and supporting the shelf at least when the shelf is in its retracted position thereabove.

10. The mechanism of claim 9, wherein the reciprocating mechanism includes a pair of worm screw drive shafts operatively connecting a first drive motor with either end of the shelf.

11. The mechanism of claim 10, wherein the reciprocating mechanism further includes a pair of 90° gear train assemblies between the first drive motor and the pair of worm screw drive shafts.

12. The mechanism of claim 11, wherein the spooling mechanism includes a second and third drive motor corresponding respectively with the first and second drive/take-up spools, and wherein the spooling mechanism further includes an upper sheet guide shaft and a lower sheet guide shaft for guiding the sheet of fabric around the shelf.

13. The mechanism of claim 12 further comprising:

a controller operatively coupling the reciprocating mechanism and the spooling mechanism, the controller configured substantially to synchronize the start and stop of the active one of the first and second take-up spools and substantially to equalize the take-up pace of an active one of the first and second take-up spools and the extension/retraction pace of the transfer shelf.

14. The mechanism of claim 13 further comprising:

one or more manually operable switches operatively coupled to the controller for extending and retracting the transfer shelf.

15. The mechanism of claim 14 further comprising:

one or more manually operable switches operatively coupled to the controller for starting and stopping one or more of the first and second take-up spools.

16. The mechanism of claim 15 which further comprises:

one or more limit switches operatively coupled with the controller for halting one or more of the extension and retraction of the transfer shelf.

17. A patient-transfer gurney comprising:

a mobile base including a horizontal frame and a horizontal lower support plate fixedly mounted on the frame;

an extendable/retractable transfer shelf disposed nominally above the lower support plate in a retracted position thereof;

a reciprocating mechanism operatively coupled with the transfer shelf alternately to extend and to retract the same between the retracted position thereof and an extended position thereof with a lower part of an outside lateral edge of the transfer shelf overlapping an upper outside laterally-positioned-gurney-confronting edge of a bed that is substantially stationary relative to the mobile base;

a spooling mechanism including first and second take-up rollers of a contiguous sheet material that tautly extends around and conforms to the transfer shelf throughout reciprocation thereof between the extended and retracted positions thereof;

wherein a lower length of the contiguous sheet material extending tautly along a lower surface of the transfer shelf is the only gurney structure that intervenes between a patient-support surface of the bed and the transfer shelf during a deployment phase of operation of the gurney in which a patient is transferred from a bed to the gurney or from the gurney to a bed; and a synchronization and pace controller operatively coupling the reciprocating mechanism and the spooling mechanism, the controller configured substantially to synchronize the start and stop of an active one of the first and second take-up rollers and substantially to equalize the take up pace of the active one of the first and second take-up rollers and an extension/retraction pace of the transfer shelf.

18. The gurney of claim 17, wherein the contiguous sheet material of the spooling mechanism extends around and conforms to the transfer shelf along a top surface of the transfer shelf and substantially around the outside edge thereof substantially without slipping or sliding therealong during the deployment phase of operation.

19. The gurney of claim 18, wherein the reciprocating mechanism includes a pair of worm screw drive shafts operatively connecting a first drive motor with either end of the shelf.

20. The gurney of claim 19, wherein the reciprocating mechanism further includes a pair of 90° gear train assemblies between the first drive motor and the pair of worm screw drive shafts.

21. The gurney of claim 20, wherein the spooling mechanism includes a second and third drive motor corresponding respectively with the first and second take-up rollers, and wherein the spooling mechanism further includes an upper sheet guide shaft and a lower sheet guide shaft for guiding the sheet of fabric around the shelf.

22. The gurney of claim 21 further comprising:

a controller operatively coupling the reciprocating mechanism and the spooling mechanism, the controller configured substantially to synchronize the start and stop of the active one of the first and second take-up rollers and substantially to equalize a take-up pace of an active one of the first and second take-up rollers and an extension/retraction pace of the transfer shelf.

23. The gurney of claim 22 further comprising:

one or more manually operable switches operatively coupled to the controller for extending and retracting the transfer shelf.

24. The gurney of claim 23 further comprising:

one or more manually operable switches operatively coupled to the controller for starting and stopping one or more of the first and second take-up rollers.

25. The gurney of claim 24 which further comprises:

one or more limit switches operatively coupled with the controller for halting one or more of the extension and retraction of the transfer shelf.

26. The gurney of claim 8, wherein the spooling mechanism operates in such a manner that the first drive/take-up spool substantially idles to permit extension of the sheet along the plane of the bottom surface of the shelf as the shelf is extended through the patient-loading position.

27. The gurney of claim 17. wherein the controller is configured further to cause the spooling mechanism to advance a potentially patient-contaminated or bed-contaminated length of the sheet of fabric along the transfer shelf and hygienically onto the first take-up roller after a deployment phase in which a patient is transferred from the gurney to a bed thereby to maintain the sheet of fabric that is spooled on the second take-up roller clean and ready for a redeployment operation on a subsequent transferee patient.

28. The gurney of claim 27, wherein the controller is configured further to cause the spooling mechanism to drive the first take- up roller while the second take-up roller is lightly braked in such manner that the potentially patient-contaminated or bed-contaminated length of the sheet of fabric along the transfer shelf is advanced onto the first take-up roller.

* * * * *